US006523318B2

(12) United States Patent
Carmel

(10) Patent No.: US 6,523,318 B2
(45) Date of Patent: Feb. 25, 2003

(54) INTEGRAL, EXTERNAL CARRYING TRACK FOR BUILDING

(75) Inventor: Aviv Carmel, Hod Hasharon (IL)

(73) Assignee: Aviv Carmel Systems Ltd. (IL)

( * ) Notice: Subject to any disclaimer, the term of this patent is extended or adjusted under 35 U.S.C. 154(b) by 0 days.

(21) Appl. No.: 09/923,545

(22) Filed: Aug. 8, 2001

(65) Prior Publication Data

US 2002/0023404 A1 Feb. 28, 2002

(30) Foreign Application Priority Data

Aug. 8, 2000 (IL) ..... 137762

(51) Int. Cl.[7] ..... B66B 7/02

(52) U.S. Cl. ..... 52/650.1; 52/29; 52/30; 187/406; 187/408; 187/363; 182/82; 182/37; 182/141; 182/43

(58) Field of Search ..... 52/27, 30, 650.1, 52/235; 248/244, 245, 246; 182/42, 37, 141; 187/406, 239, 900

(56) References Cited

U.S. PATENT DOCUMENTS

| | | | | | |
|---|---|---|---|---|---|
| 292,265 | A | * | 1/1884 | Stoddard | 182/103 |
| 476,885 | A | * | 6/1892 | Loyd | 182/37 |
| 525,014 | A | * | 8/1894 | Griesemer | 144/287 |
| 5,447,213 | A | * | 9/1995 | Habicht | 187/238 |
| 5,649,607 | A | * | 7/1997 | Chang et al. | 182/36 |
| 5,715,906 | A | * | 2/1998 | Abe | 182/141 |
| 5,927,432 | A | * | 7/1999 | Hershtik | 182/82 |

* cited by examiner

*Primary Examiner*—Carl D. Friedman
*Assistant Examiner*—Basil Katcheves
(74) *Attorney, Agent, or Firm*—Blank Rome LLP

(57) ABSTRACT

A carrying track for a building, which includes a building including a plurality of floors, a track extending from a lower floor of the building to a floor above the lower floor, the track structurally forming part of the floors and part of an outside surface of the building, wherein the track includes two vertical halves with a gap formed between, the gap being exposed to the outside surface of the building and extending inwards from the outside surface.

21 Claims, 7 Drawing Sheets

INTEGRAL, EXTERNAL CARRYING TRACK FOR BUILDING

FIELD OF THE INVENTION

The preset invention relates generally to carrying tracks for elevators and the like for buildings, and particularly to an integral carrying track for a building.

BACKGROUND OF THE INVENTION

Many buildings, especially high-rise buildings, hotels and hospitals, for example, have various elevators for carrying persons or cargo from one floor to another. Most elevators are internal to the building, although external carrying tracks and elevators are also very well known. In general, external carrying tracks are temporary structures used for various purpose, such as for transporting building materials during construction of the building. Such tracks are attached to an outside surface of the building and are generally dismantled upon completion of constructing or renovating the building.

SUMMARY OF THE INVENTION

The present invention seeks to provide a novel external carrying track for a building, which is integrally built into the building. The carrying track is not a temporary track like the prior art, but rather an aesthetically pleasing, integral part of the structure of building, along which can be slidingly mounted elevator cabs, scaffolding, cranes and the like.

There is thus provided in accordance with a preferred embodiment of the present invention a carrying track for a building, including a building including a plurality of floors, a track extending from a lower floor of the building to a floor above the lower floor, the track structurally forming part of the floors and part of an outside surface of the building, wherein the track includes two vertical halves with a gap formed between, the gap being exposed to the outside surface of the building and extending inwards from the outside surface.

In accordance with a preferred embodiment of the present invention the track extends from one floor to another or from a ground floor to an uppermost floor of the building.

Further in accordance with a preferred embodiment of the present invention the gap has an extension extending generally perpendicular thereto formed on at least one floor of the building.

Still further in accordance with a preferred embodiment of the present invention the gap and the extension together have a generally T-shaped cross-section.

In accordance with a preferred embodiment of the present invention the gap has the extension formed on each floor of the building.

Further in accordance with a preferred embodiment of the present invention the halves have a generally trapezoidal cross-section Still further in accordance with a preferred embodiment of the present invention the halves are formed of poured concrete, metal (such as steel or aluminum), structural plastic, wood or combination thereof.

In accordance with a preferred embodiment of the present invention, an elevator cab, rescue compartment, crane, building cleaning apparatus, or scaffold may be sliding mounted along the track.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Reference is now made to FIGS. 1, 2A, 2B and 3 which illustrate a carrying track 10 for a building 12 (FIG. 3) constructed and operative in accordance with a preferred embodiment of the present invention.

Figure 1:
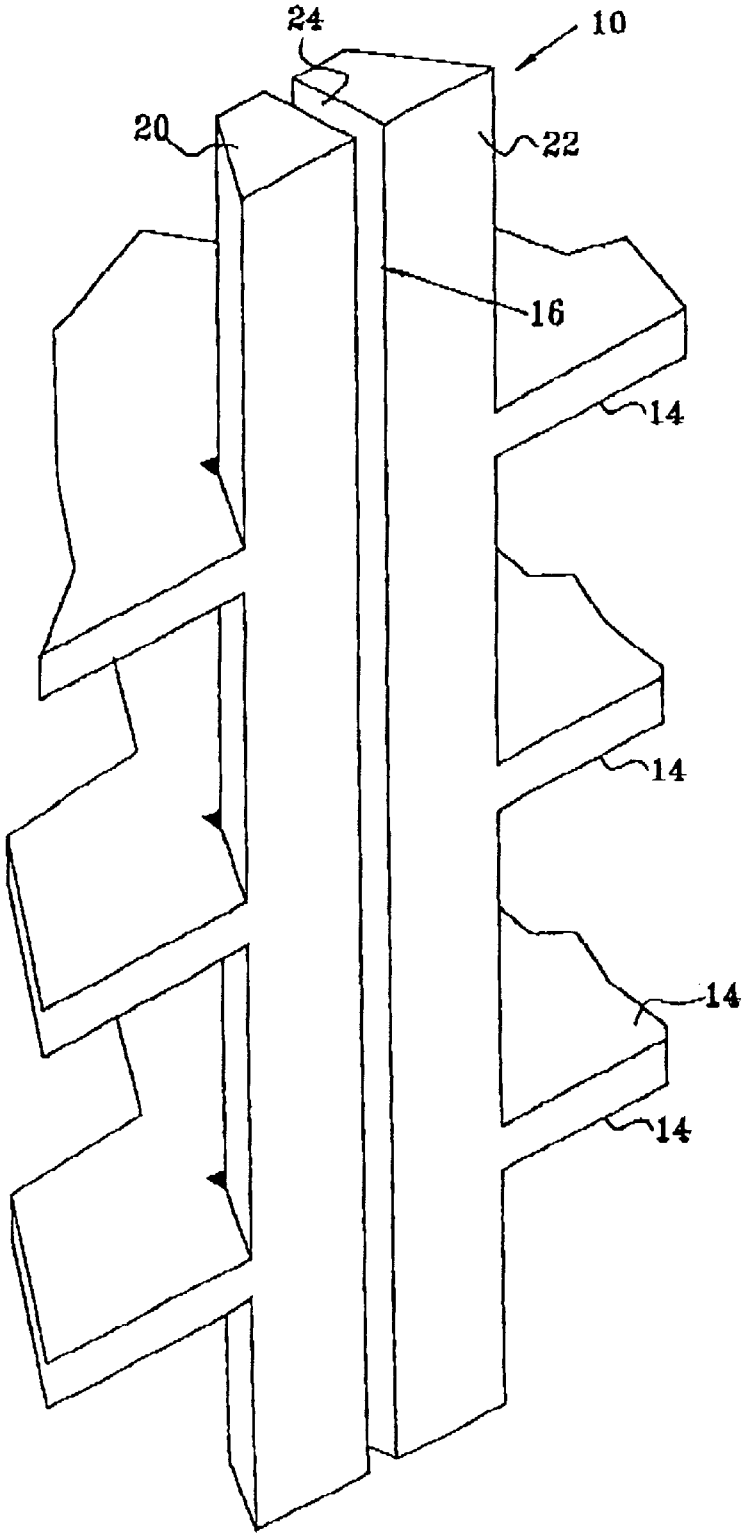
FIG. 1 is a simplified, partially cutaway, pictorial illustration of a carrying track for a building, constructed and operative in accordance with a preferred embodiment of the present invention.
Figure 2A:
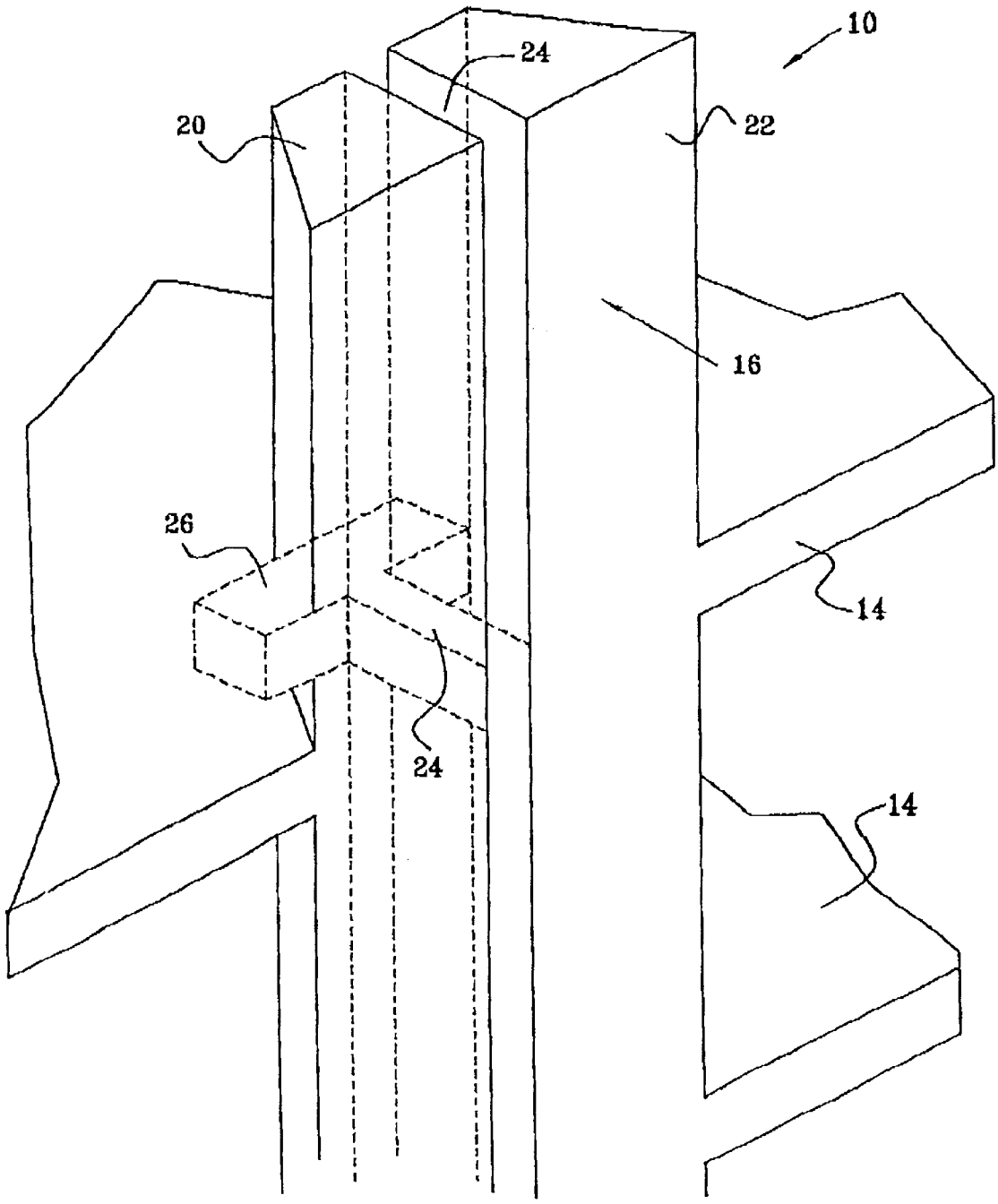
FIGS. 2A and 2B are simplified pictorial and topview, sectional illustrations, respectively, of carrying track of FIG. 1.
Figure 2B:
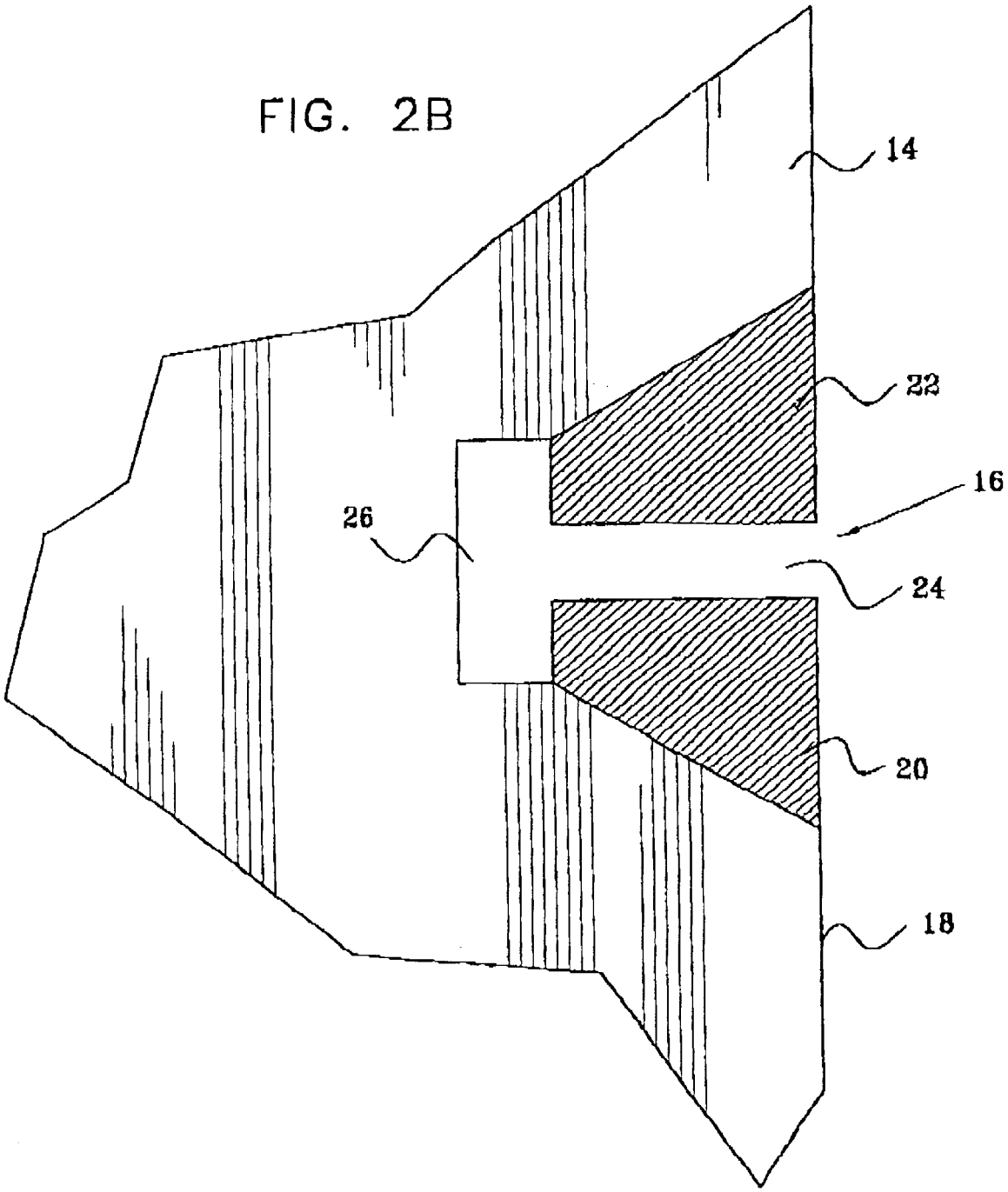
Figure 3:
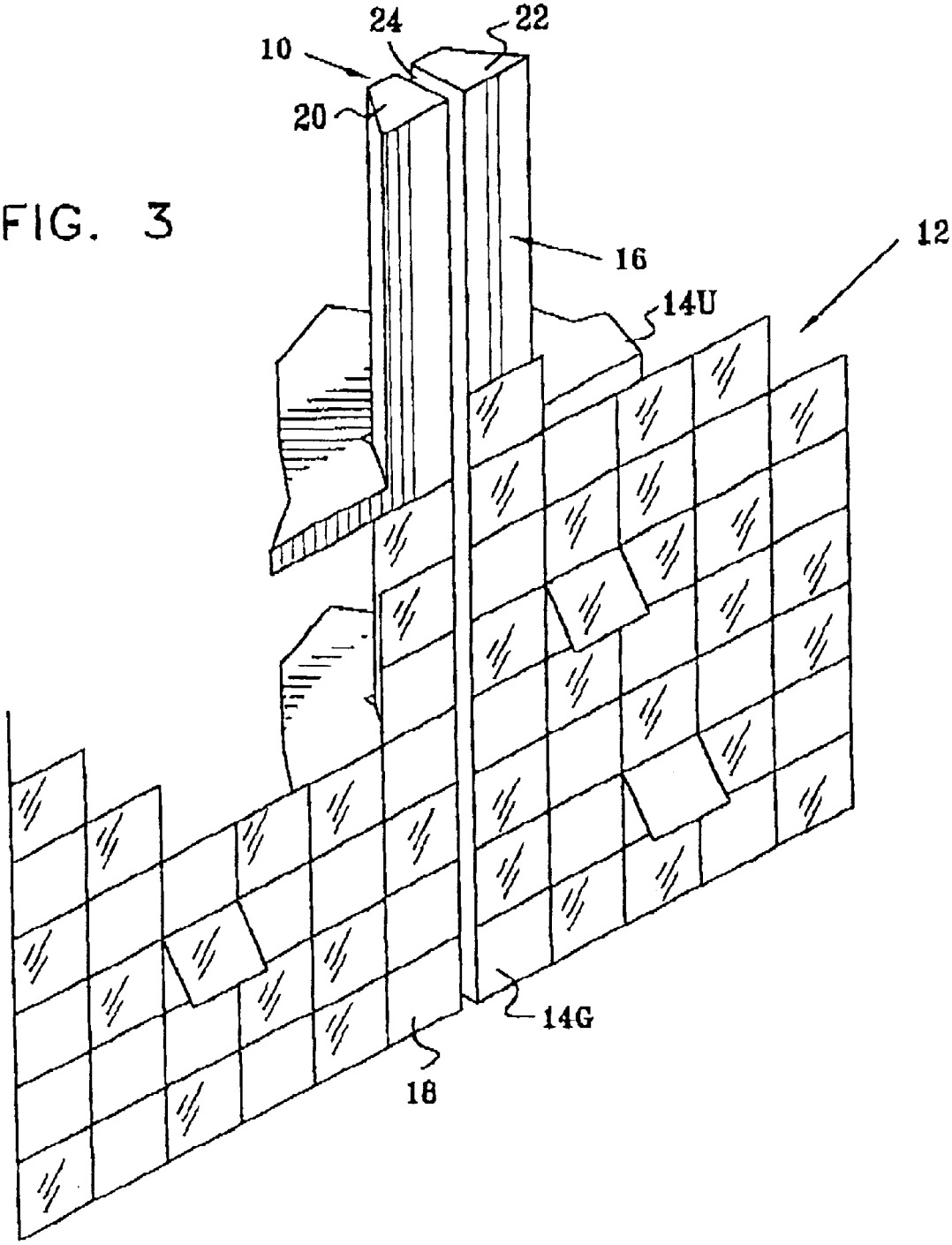
FIG. 3 is a simplified pictorial illustration of the carrying track of FIG. 1, as viewed from the outside of the building.

Building 12 preferably includes a plurality of floors 14. A track 16 preferably extends from one floor to another, such as from a lower floor 14A of building 12 to one or more floors above the lower floor 14A. As seen in FIG. 3, track 16 preferably extends from a ground floor 14G to an uppermost floor 14U. Track 16 preferably structurally forms part of floors 14 and part of an outside surface 18 of building 12. Track 16 preferably includes two vertical halves 20 and 22 with a gap 24 formed between. Gap 24 is preferably exposed to the outside surface 18 of building 12 and extends inwards from the outside surface 18. Halves 20 and 22 may have a generally trapezoidal cross-section (FIGS. 2A and 2B), although other cross-sectional shapes are also within the scope of the invention.

Gap 24 preferably has an extension 26 extending generally perpendicular thereto, formed on one or more, preferably all, floors 14 of building 12. Gap 24 and extension 26 preferably together have a generally T-shaped cross-section, although other cross-sectional shapes are also within the scope of the invention. Halves 20 and 22 may be formed of poured concrete with a mold being used to form the gap 24 and extension 26. However, it is to be emphasized that the invention is not limited to this material, and the carrying track 10 can be made of any suitable building material, such as plastics wood or metal or any combination thereof, for example.

Figure 4:
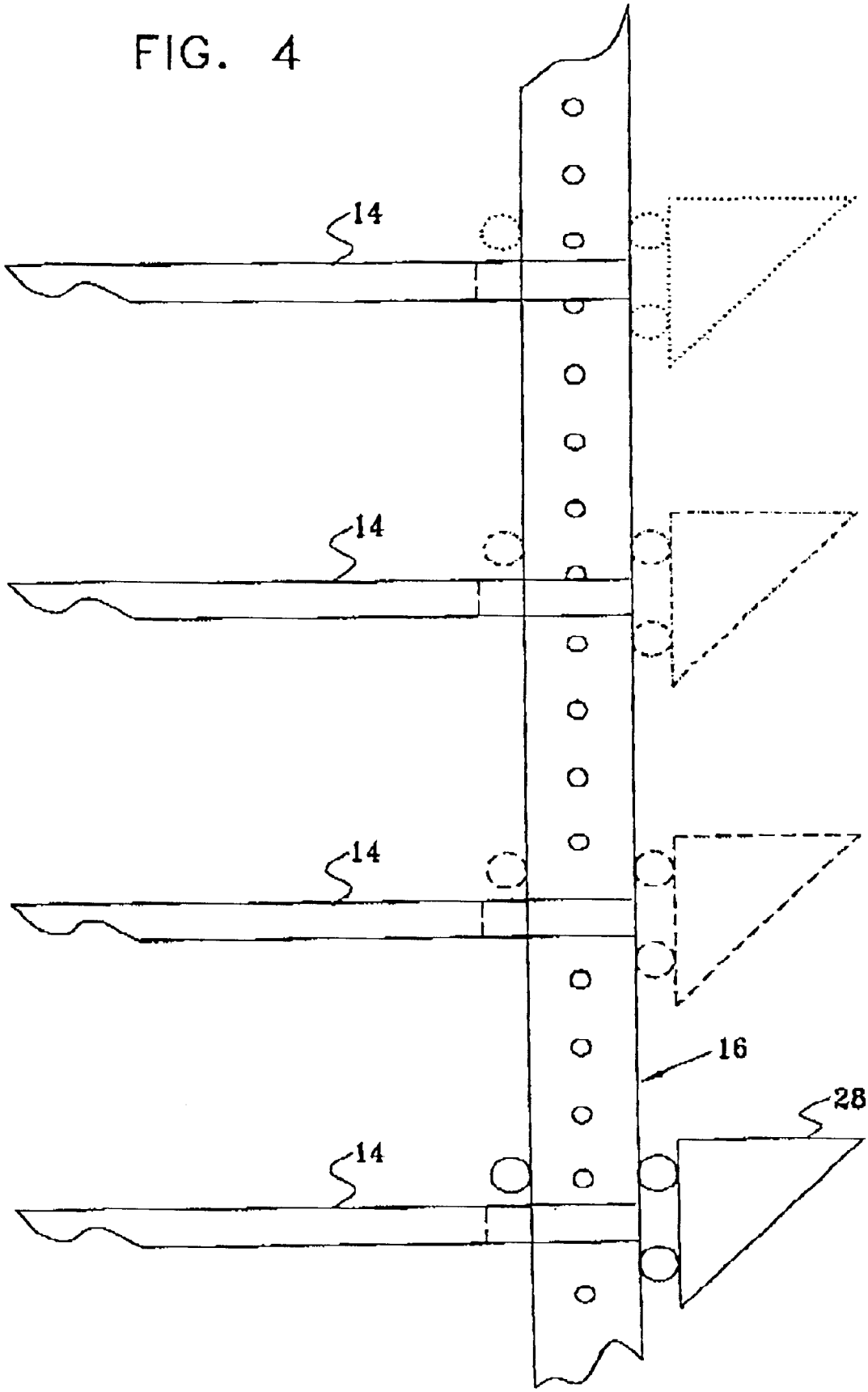
FIG. 4 is a simplified pictorial illustration of an elevator cab slidingly mounted on the carrying track of FIG. 1, in accordance with a preferred embodiment of the present invention.
Figure 5:
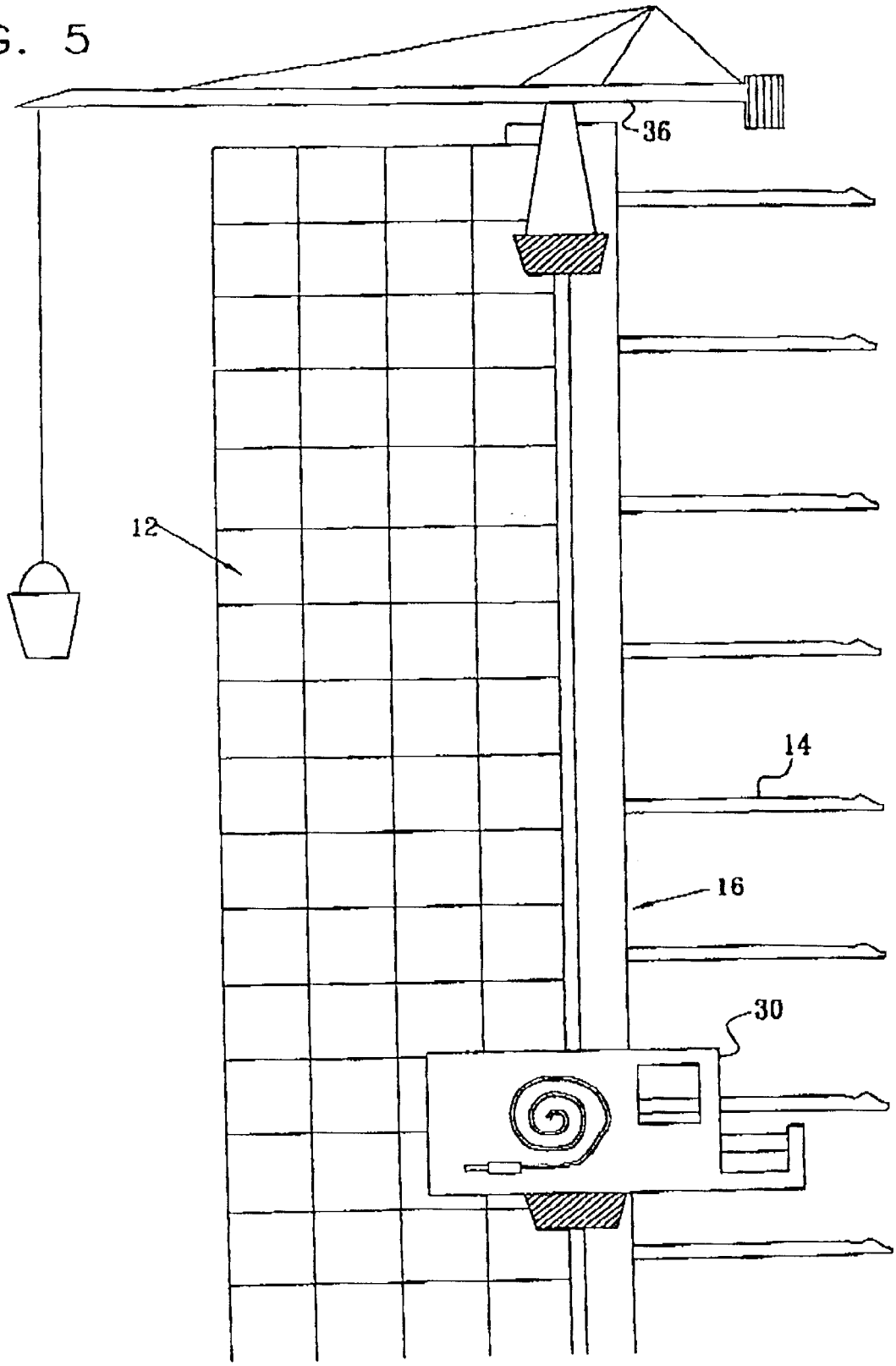
FIG. 5 is a simplified pictorial illustration of a rescue compartment and building cleaning apparatus slidingly mounted on the carrying tack of FIG. 1, in accordance with a preferred embodiment of the present invention.
Figure 6:
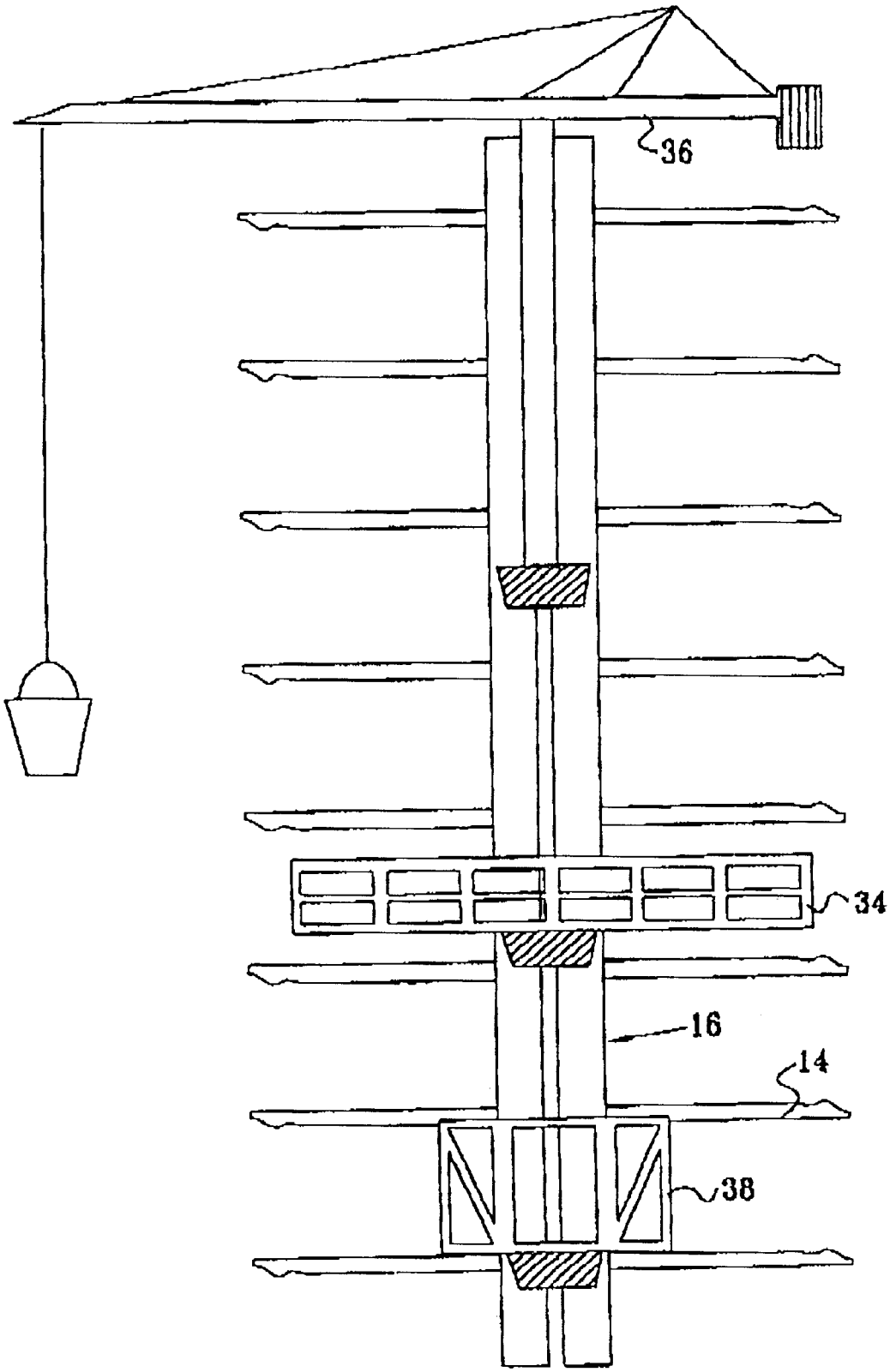
FIG. 6 is a simplified pictorial illustration of a scaffold and a crane slidingly mounted on the carrying track of FIG. 1, in accordance with a preferred embodiment of the present invention.

Reference is now made to FIGS. 4–6 which illustrate various embodiments of the present invention which utilize carrying track 10. In FIG. 4, an elevator cab 28 is sliding mounted along track 16. In FIG. 5, a rescue compartment 30 and building cleaning apparatus 32 are slidingly mounted along track 16. In FIG. 6, a scaffold 34, a crane 36, and an external construction elevator 38 are slidingly mounted along track 16, and may be moved along track 16 by means of an external or built-in motor (not shown). Different kinds of elevators, scaffolds and cranes and the like can be used at the same time on track 16, if desired. The can slide on the entire length of the track or only on part of the length, if desired, and can stop at any point along track 16. It is appreciated that these are just some of the limitless possibilities of the uses of carrying track 10.

It is noted that carrying track 10 is not a temporary track like the prior art, but rather an aesthetically pleasing, integral part of the structure of building 12. Carrying track 10 may form part of a rescue system for the building, such as for quick and safe removal of persons from a fire or terrorist attack, for example. Carrying track 10 may also be part of systems for cleaning windows and exteriors of buildings, or systems for transporting goods from one floor to another.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A building comprising:

a plurality of floors;

a plurality of vertical supports, integrally formed with said plurality of floors, at least one of the plurality of vertical supports having an outward facing surface exposed to an outside surface of said building and defining a track extending from a lower floor of said building to a floor above the lower floor, wherein said track comprises a vertical gap extending inward from said outward facing surface.

2. A building according to claim 1 wherein said track extends from a ground floor to an uppermost floor of said building.

3. A building according to claim 1 wherein said gap has an extension extending generally perpendicular thereto formed at a vertical location corresponding to at least one floor of said building.

4. A building according to claim 3 wherein said gap and said extension together have a generally T-shaped cross-section.

5. A building according to claim 3 wherein said gap has the extension formed on each floor of said building.

6. A building according to claim 4 wherein said gap has the extension formed on each floor of said building.

7. A building according to claim 1 wherein said halves have a generally trapezoidal cross-section.

8. A building according to claim 1 wherein said vertical support having an outward facing surface is formed of at least one of poured concrete, metal, plastic and wood.

9. A building according to claim 1 and further comprising an elevator cab slidingly mounted along said track.

10. A building according to claim 1 and further comprising a rescue compartment slidingly mounted along said track.

11. A building according to claim 1 and further comprising a crane slidingly mounted along said track.

12. A building according to claim 1 and further comprising building cleaning apparatus slidingly mounted along said track.

13. A building according to claim 1 and further comprising a scaffold slidingly mounted along said track.

14. A method for transporting a load along a vertical outside surface of a building, the method comprising:

constructing a building having a plurality of floors and an external carrying track integrally built into the building and extending from a lower floor of said building to a floor above the lower floor, including:

providing a vertical gap extending inward from an outward facing surface of at least one of a plurality of vertical supports; and integrally forming the plurality of vertical supports with each of the plurality of floors such that said outward facing surface is exposed to an outside surface of said building and said gap extends inward from the outside surface of the building.

15. A method according to claim 14 and also comprising:

mounting an elevator cab for translation along said external carrying track.

16. A method according to claim 14 and also comprising, upon occurrence of an emergency:

mounting a rescue compartment for translation along said external carrying track, thereby to remove persons or contents from the building by loading the persons or contents into said rescue compartment.

17. A method according to claim 14 and also comprising: mounting a crane for translation along said external carrying track.

18. A method according to claim 14 and also comprising:

mounting building cleaning apparatus for translation along said external carrying track.

19. A method according to claim 14 and also comprising:

mounting a scaffold for translation along said external carrying track.

20. A building according to claim 1 wherein at least one of said vertical supports comprises two vertical portions, each defining engagement surfaces between which the gap is formed, said engagement surfaces being exposed to said outside surface of said building and extending inward from said outside surface.

21. A building according to claim 20 wherein said two vertical portions comprise two separate vertical halves.

* * * * *